US009049923B1

(12) United States Patent
Delagey et al.

(10) Patent No.: US 9,049,923 B1
(45) Date of Patent: Jun. 9, 2015

(54) POWERED HEIGHT ADJUSTABLE DESKTOP

(71) Applicant: Stand Tall, LLC, High Point, NC (US)

(72) Inventors: Nico Vincent Delagey, High Point, NC (US); Brandon Daniel Johnson, Greensboro, NC (US); Todd Allison Ferrell, High Point, NC (US)

(73) Assignee: Stand Tall, LLC, High Point, NC (US)

( * ) Notice: Subject to any disclaimer, the term of this patent is extended or adjusted under 35 U.S.C. 154(b) by 0 days.

(21) Appl. No.: 14/152,193

(22) Filed: Jan. 10, 2014

Related U.S. Application Data

(60) Provisional application No. 61/750,806, filed on Jan. 10, 2013.

(51) Int. Cl.
*A47B 9/00* (2006.01)
*A47B 21/02* (2006.01)

(52) U.S. Cl.
CPC . *A47B 9/00* (2013.01); *A47B 21/02* (2013.01); *A47B 2200/0041* (2013.01)

(58) Field of Classification Search
CPC ... A47B 21/02; A47B 9/02; A47B 2200/0041
USPC ..... 108/138, 144.11, 145, 147, 50.01, 90, 108/93, 96, 106
See application file for complete search history.

(56) References Cited

U.S. PATENT DOCUMENTS 4,194,452 A * 3/1980 Crowther et al. ..... 108/138
4,249,749 A * 2/1981 Collier ..... 280/35
4,515,086 A 5/1985 Kwiecinski et al.
4,682,750 A * 7/1987 Rudolph et al. ..... 108/145
5,549,052 A * 8/1996 Hoffman ..... 108/139
6,038,982 A * 3/2000 Witzig ..... 108/3
6,991,199 B2 * 1/2006 Carpentier ..... 248/122.1
7,677,518 B2 * 3/2010 Chouinard et al. ..... 248/370
7,806,384 B2 10/2010 Doyle
8,015,638 B2 * 9/2011 Shimada et al. ..... 5/611
8,091,842 B2 1/2012 Thomas et al.
8,322,292 B2 * 12/2012 Chen ..... 108/43
8,671,853 B2 * 3/2014 Flaherty ..... 108/138
2005/0248239 A1 11/2005 Newhouse et al.
2007/0163475 A1 * 7/2007 Murphy ..... 108/147

(Continued)

OTHER PUBLICATIONS

Varidesk by Gemmy Industries Corp., www.varidesk.com; known at least as early as Mar. 30, 2013, 2 pgs.

(Continued)

*Primary Examiner* — Daniel Rohrhoff
(74) *Attorney, Agent, or Firm* — Womble Carlyle Sandridge & Rice, LLP

(57) ABSTRACT

A powered height adjustable desktop having a base with a fixed peripheral wall defining a cavity and a cover defining a horizontal work surface. A lift mechanism supports the cover relative to the base. The lift mechanism includes a linkage with at least one pair of lift arms pivotably connecting each side of the base to a respective side of the cover and a powered actuator attached to the base and operatively connected to the linkage. The actuator selectively activates the linkage to rotate the lift arms from a relatively horizontal position to at least one substantially fixed upright position, thereby raising the work surface from a sitting height to a standing height. At the sitting height, the cover rests upon the peripheral wall to fully enclose the cavity. At the standing height, the cover is spaced above and offset forward of the base.

15 Claims, 4 Drawing Sheets

(56) References Cited

U.S. PATENT DOCUMENTS

| | | | | |
|---|---|---|---|---|
| 2013/0139736 | A1 | 6/2013 | Flaherty | |
| 2013/0145972 | A1* | 6/2013 | Knox et al. | 108/145 |
| 2013/0199420 | A1 | 8/2013 | Hjelm | |
| 2014/0158026 | A1* | 6/2014 | Flaherty | 108/96 |

OTHER PUBLICATIONS

Stir Kinetic Desk by Stirworks, www.stirworks.com, known at least as early as Sep. 26, 2013, 2 pgs.

Kangaroo by Ergo Desktop, www.ergodesktop.com, known at least as early as Dec. 31, 2009, 3 pgs.

WorkFit by Ergotron, www.ergotron.com, known at least as early as Dec. 18, 2013, 2 pgs.

NextDesk, www.nextdesks.com, known at least as early as Jan. 9, 2014, 7 pgs.

VertDesk by Beyond the Office Door, www.beyondtheofficedoor.com, known at least as early as Jan. 9, 2014, 4 pgs.

Series 7 by Steel Case, www.steelcase.com, known at least as early as Jan. 9, 2014, 2 pgs.

Carlyle lift-top occasional table by Ashley Furniture, www.furnituredeals.com, known at least as early as Jan. 9, 2014, 1 pg.

* cited by examiner

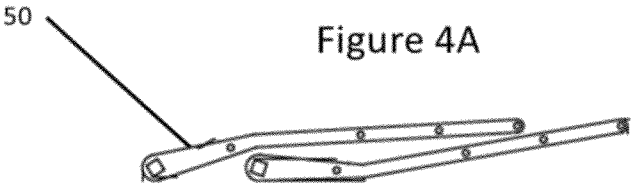
Figure 4A
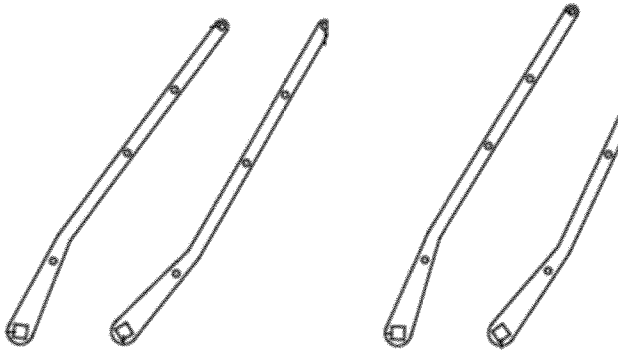
Figure 4B
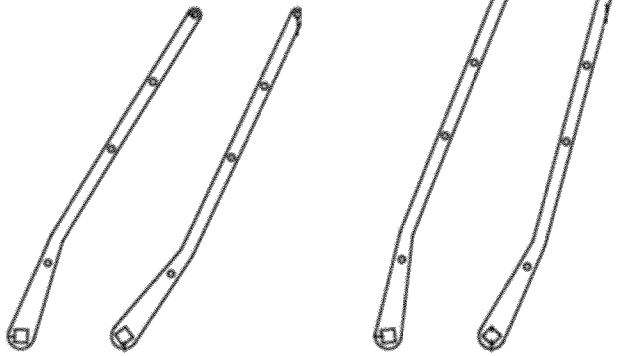
Figure 4C
Figure 4D
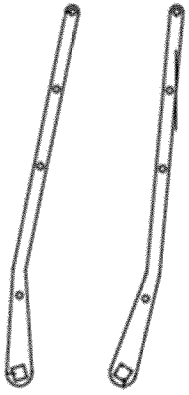
Figure 4E

POWERED HEIGHT ADJUSTABLE DESKTOP

PRIORITY

This application claims priority to U.S. provisional application Ser. No. 61/750,806, filed Jan. 10, 2013, the contents of which are incorporated herein by reference.

FIELD OF INVENTION

The present disclosure relates to powered height adjustable supports. Particularly, the present disclosure relates to desks, or desktop supports, providing a work surface with variable height.

BACKGROUND

Office workers often sit at a desk for hours at a time. These same office workers often spend the majority of their eight, or more, hour work day in a sitting position. Research has shown that standing up for at least part of one's workday has many health benefits and can improve both the quality and longevity of life, as well as worker productivity and satisfaction.

Some stand-up desks are currently available. These stand-up desks have a work surface that is permanently positioned at a height for standing comfort, or generally provide the ability to raise the desk work surface to a higher level, for a comfortable, ergonomic standing work position. However, presently available stand-up desks use the deck's legs to lift the desktop, limiting the styling of these desks. In other cases, manual actuation is required to transition the desktop from a sitting height to a standing height.

SUMMARY

Applicants have determined that there is a need for a powered desktop for a worker in both a sitting and standing position, which may be used on top of an existing desk or table top or alternatively integrated into furniture.

One aspect of the present disclosure includes a height adjustable desktop comprising a base having a fixed peripheral wall extending upwardly from the base, defining a cavity. A cover defines a horizontal work surface for the desktop. A lift mechanism supports the cover relative to the base. The lift mechanism comprises a linkage including at least one pair of lift arms pivotably connecting each side of the base to a respective side of the cover. The lift mechanism also comprises a powered actuator attached to the base that is operatively connected to the linkage. The powered actuator is configured to selectively activate the linkage to rotate the lift arms from a relatively horizontal position to at least one substantially fixed upright position, thereby raising the work surface from a sitting height to a standing height. At the sitting height, the cover rests upon the peripheral wall to fully enclose the cavity. At the standing height, the cover is spaced above and offset forward of the base.

Another aspect is that the desktop acts as a support. The support includes a base for placement upon an existing desk or table and a cover defining a horizontal work surface. The support also includes a powered lift mechanism supporting the cover relative to the base. The lift mechanism comprises a linkage comprising at least one pair of lift arms pivotably connecting each side of the base to a corresponding side of the cover and a linear actuator attached to the base and operatively connected to the linkage. The lift mechanism further comprises a connecting rod capable of rotation along with at least one of the lift arms; and a lever converting linear motion of the linear actuator to a torque about the connecting rod. The linear actuator is configured to selectively activate the linkage to rotate the lift arms from a relatively horizontal position to at least one substantially fixed upright position, thereby raising the work surface from a sitting height to a standing height. At the standing height, the cover is spaced above and offset forward of the base.

Yet another aspect includes a device comprising a cover defining a horizontal work surface and a lift mechanism supporting the cover. The lift mechanism comprises a linkage comprising at least one pair of lift arms pivotably connected to each side of the cover and at least one support rod pivotably attached to at least one of the lift arms and slidably attached to the cover. The lift mechanism further comprises a powered actuator operatively connected to the linkage. The powered actuator is configured to selectively activate the linkage to cause rotation of the lift arms, thereby raising the cover from the sitting height to the standing height.

BRIEF SUMMARY OF THE DRAWINGS

FIGS. 4A-4E show the link arms according to embodiments of the present disclosure in several rotational positions.

DETAILED DESCRIPTION

Figure 1:
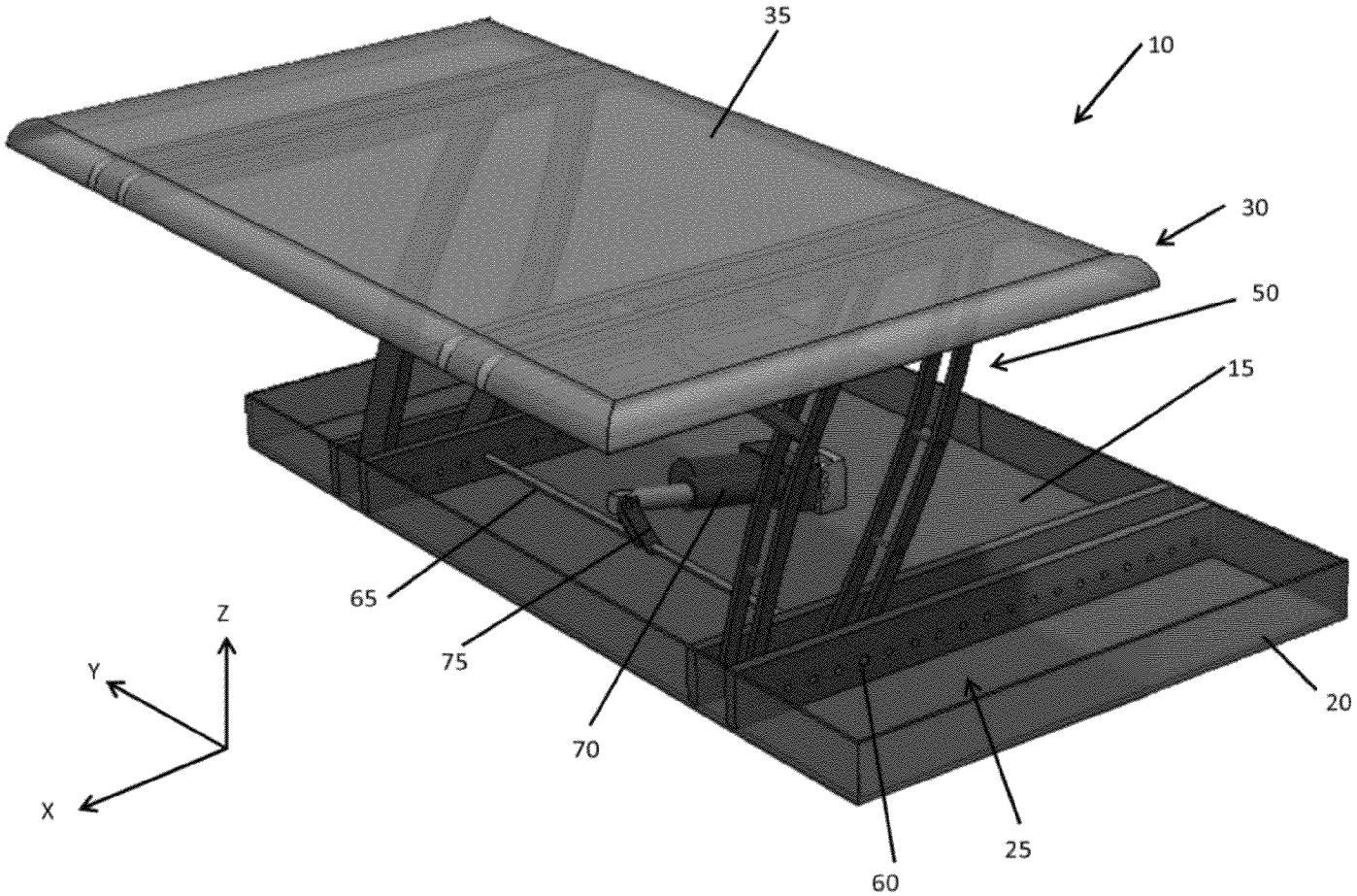
FIG. 1 shows an isometric view of a desktop according to the present disclosure at the standing height.

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Some embodiments of the disclosed powered height adjustable desktop provide a device that can be placed on an existing desk or table to act as support for computers or office equipment, so simply provide a raised work surface. These embodiments will allow the user to change an existing sitting desk configuration to a sitting-or-standing configuration without removing or replacing the existing desk. The illustrated embodiment provides a portable desktop that can be moved to alternative work surfaces, allowing a single worker to work in plural locations, or allowing the desktop to be rotated around an office for periodic use by each worker on a team.

Other embodiments of the disclosed powered height adjustable desktop can include the desktop integrated into furniture pieces to provide a desk with a work surface that is height adjustable, thereby also providing the ability to act as a support for computers or other equipment. In some integrated embodiments, the entire work surface of the desk may be height adjustable. In other integrated embodiments, the adjustable desktop can form a portion of the desk's work surface. Preferably, the sitting position of the adjustable desktop would provide the cover thereof flush with the remainder of the desk's work surface. These integrated embodiments could replace fixed height desks or could be the result of modifying an existing fixed height desk.

The disclosed desktops are powered, as compared to manual, thereby encouraging the user to stand, by foregoing the often complicated or cumbersome process necessary to operate manually-adjustable stand-up desks. As used herein "powered" includes activation of the desktop's motion by the user through a desktop mounted button, or a remote control button, and activation automatically by proximity sensors or other means incorporated within the desktop. As used herein, "powered" includes electric powered, liquid powered (i.e. hydraulic), and air powered (i.e. pneumatic). The limits of the desktop motion can be provided by physical stops, limit switches and/or height sensors, resulting in a work surface of the desktop operating within a predetermined distance of travel.

Turning to the figures, FIG. 1 shows a desktop 10 according to some embodiments of the present invention in a raised position, also referred to as the standing position. The desktop 10 may comprise a base 15 having a fixed peripheral wall 20 (with front, rear, and two side walls) extending upward from the base 15. The base 15 and peripheral wall 20 define five sides of a cavity 25. A cover 30 provides a work surface 35. Preferably, the work surface 35 will remain substantially horizontal as the cover 30 is raised and lowered relative to the base 15. In the embodiment illustrated, the work surface 35 is intended to replace or supplement the top surface of an existing desk or table by having the desktop 10 sitting on top thereof. In other embodiments, the work surface 35 may supplement the top surface of a desk by being inlayed therein. In further embodiments, the work surface 35 itself may provide the top surface of a desk.

As used herein, "horizontal" means substantially parallel with the base 15, and parallel to the XY plane as defined in FIG. 1. Reference is made to FIG. 1 to further define the front and rear direction as along the X-axis. The Y-axis defines the lateral direction of the desktop 10. Reference to a side or side-view of the desktop 10 means a view along the lateral direction. The Z-axis axis defines the height direction along which the cover 30 is described as being "raised" and "lowered."

Figure 2:
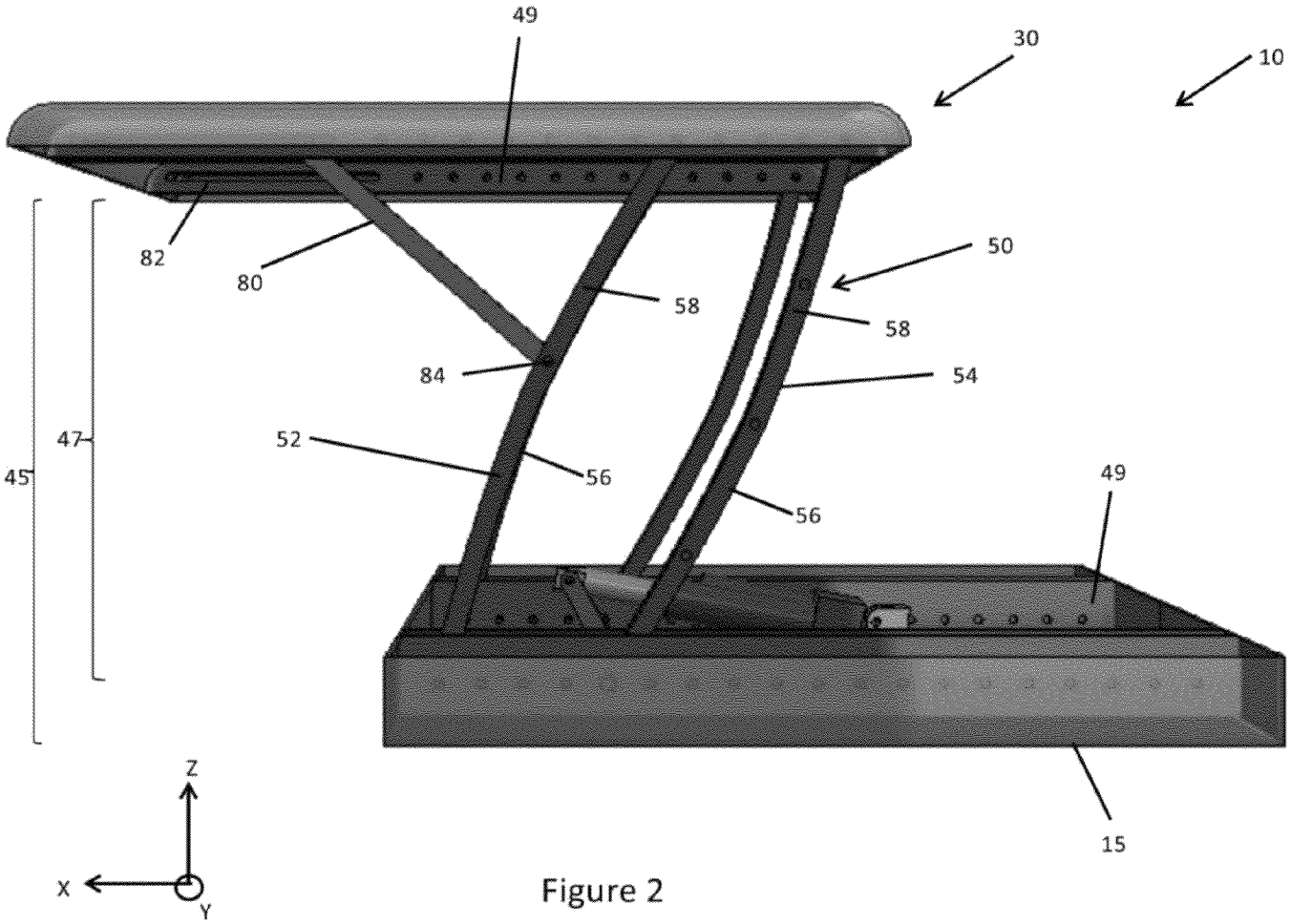
FIG. 2 shows a side view of the desktop according to FIG. 1.

The cover 30 raises and lowers relative to the base 15 with the assistance of a powered lift mechanism 45. The lift mechanism 45 may have a modular construction for disassembly from the cover 30 and the base 15. The lift mechanism includes a linkage 47 comprising at least two pairs of lift arms 50, one pair for each side of the desktop 10. In other words, in the illustrated embodiment, at least one pair of lift arms connects a first side of the cover 30 to a first side of the base 15 and at least one pair of lift arms connects a second side of the cover 30 to a second side of the base 15. Where the first side is a first half along the lateral direction and the second side is a second half along the lateral direction. FIG. 1 shows a total of four pairs of lift arms 50. The total number of lift arms 50 can change based upon the amount of weight the work surface 35 is configured to support and the strength of each pair of lift arms 50 individually. As seen in FIG. 2, each pair of lift arms 50 includes a front lift arm 52 and a rear lift arm 54. Each of the lift arms 50 includes a lower arm portion 56 associated with the base 15 and an upper arm portion 58 associated with the cover 30. When seen from a side view, in the raised position, each front lift arm 52 has the upper arm portion 58 angled rearward relative to the lower arm portion 56. When seen from a side view, in the raised position, each rear lift arm 54 has the upper arm portion 58 angled forward relative to the lower arm portion 56 thereof.

The upper arm portion 58 of each lift arm 50 may be pivotally connected relative to the cover 30. In some embodiments the upper arm portions 58 connect at a rear half of the cover 30. The lower arm portion 56 of each lift arm 50 may be pivotally connected relative to the base 15 with one or more bearing surfaces 60. In some embodiments, the lower arm portions 56 connect at a front half of the base 15. With this configuration, rotation of the pairs of lift arms 50 toward the raised position will cause the cover 30 to not only rise to an increased height above the base 15, but the work surface 35 will also be offset in a forward direction relative to the base 15 as best seen in FIG. 2. This offset in a forward direction allows the user to step further back from the desk while in the standing position, providing a less confined workspace. This offset is due in part to the illustrated embodiment where each lift arm 50 is understood to rotate in the same direction along with each other lift arm 50. In this case, the lift arms 50 all pivot along a front to rear direction about a pivot axis that runs in the lateral direction of the desktop 10.

In the embodiment shown, the lift mechanism 45 further comprises a connecting rod 65 rotationally connected to at least one of the front and rear lift arms 52, 54 of at least one of the pairs of lift arms 50, such that rotation of the connecting rod 65 will cause a resulting rotation of the attached lifting arm 50. In some embodiments a plurality of connecting rods 65 may be used. For example, separate connecting rods 65 can be used for the front lift arms 52 and the rear lift arms 54.

In the embodiment of FIG. 1, the connecting rod 65 is driven by a powered actuator 70 via a lever 75. In the embodiment shown, a linear actuator is used. The linear actuator may be electric or may be one of a pneumatic or hydraulic ram. Extension of the piston of actuator 70 rotates the connecting rod 65 forward, raising the pairs of lift arms 50 and thus the cover 30. As the actuator 70 retracts, the connecting rod 65 rotates in a rearward direction, lowering the pairs of lift arms 50 and bringing down the cover 30. The desktop 10 of the present disclosure is not limited to use of a linear actuator. The connecting rod 65 may also be directly or indirectly rotated by other driving means, such as motors. In other embodiments, the pairs of lift arms 50 may themselves be directly rotated by an actuator 70, such as the drive axle of a motor, without the use of a connecting rod 65.

In at least embodiments where the actuator 70 is electric, a power supply (not shown) is included that is configured to receive power from an outlet or battery source. The actuator 70 may be triggered by a switch (not shown) attached to the peripheral wall 20 for easy access by the user. In other embodiments, a remote control may be provided to control the actuator 70. In some embodiments the switch or remote control may allow for selection of more than two heights, including a height setting programmable by the user for their optimal standing position comfort. The actuator 70 is configured to drive the cover 30 between the closed position of FIG. 3 and the open, raised position of FIG. 1. The actuator 70 is configured to allow the user to stop the actuator 70, as it is moving the cover 30, to selectively fix, i.e. hold steady, the work surface 35 at various heights within the full range of motion of the cover 30.

In some embodiments of the present invention a support rod 80 may be used to provide additional support to the cover 30 in its raised position. In the embodiment shown in FIG. 2, the support rod 80 is pivotably connected at a joint 84 to at least one of the front lift arms 52 and slidably connected with respect to the cover 30 via a slotted track 82 attached to or formed as part of the cover 30. To provide a smooth connection between the support rod 80 and the cover 30, a cam follower, track roller or ball bearing carriage may be used. The support rod 80 may be biased in an upward direction to apply a constant force on the cover 30. For example, the joint 84 may include a torsion spring biasing the support rod 80 in a clockwise direction as viewed in FIG. 1

Figure 3:
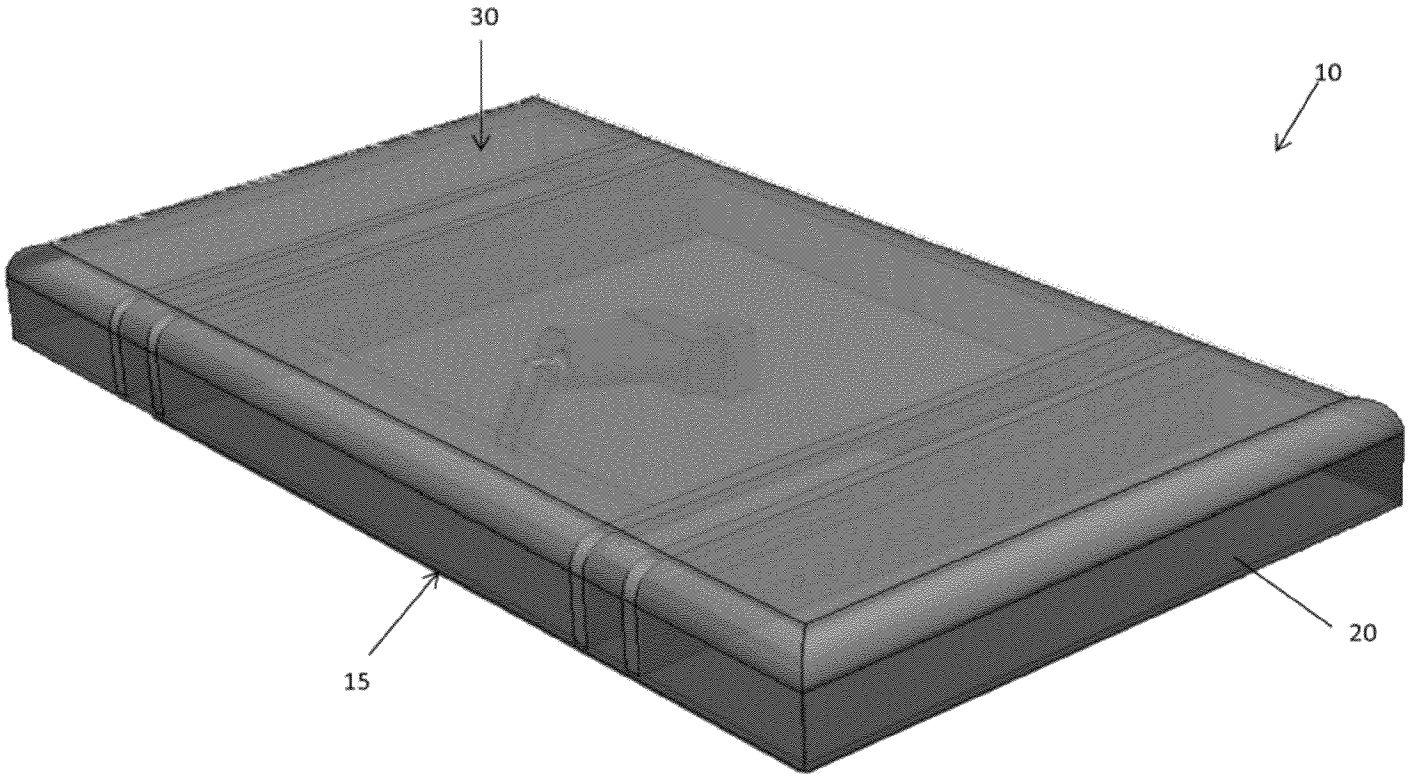
FIG. 3 shows an isometric view of the desktop according to FIG. 1 at the sitting height.

In the illustrated embodiment of FIG. 3, the cover 30 is configured to rest upon the peripheral wall 20 when the cover 30 is provided at its lowest height. This lowest position of the cover 30 may be referred to as the closed position because the cover 30 is able to fully enclose the cavity 25, concealing all of the elements disposed therein. In other embodiments the closed position may result in the work surface 35 becoming flush with the top surface of a desk.

FIG. 4 shows a pair of lift arms 50 of the present disclosure, as previously seen in FIGS. 1 and 2, at various angles of rotation. FIG. 4A shows the lift arms 50 in a generally horizontal position corresponding with the sitting height of the desktop 10. Because the lift arms 50 of the illustrated embodiment are not perfectly linear, they are not exactly horizontal. The configuration of each of the lift arms 50 allows the arms to nest together in a compact manner when the lift arms are in their generally horizontal position. As can be seen from FIGS. 4A-E, the lift arms 50 maintain the top ends of each arm at the same height throughout the rotation of the lift arms, providing the ability to maintain a substantially level horizontal work surface at any height between fully retracted and the highest height. FIG. 4B shows the lift arms at 50 degrees of rotation, FIG. 4C shows 55 degrees of rotation, FIG. 4D shows 65 degrees of rotation and FIG. 4E shows 75 degrees of rotation. In the illustrated embodiment of FIG. 4E, the lift arms 50 provide a vertical height of approximately 14 inches between their bottom connection points and their top connection points. Each of FIGS. 4B-4E is understood to show a substantially upright position capable of supporting the cover 30 at various standing height.

As should be understood from FIGS. 3 and 4A, packaging of the lift mechanism 45 fully within the cavity 25 when the cover 30 is in the closed position influences the design and arrangement thereof. However, with this goal in mind, the pairs of lift arms 50 may be brought closer together or spaced further apart. While presently represented near the center of the base 15, the actuator 70 and lever 75 could be located laterally outside of the pairs of lift arms 50. These and other changes in arrangement will be understood by one skilled in the art while maintaining the fully enclosed aspect of the closed, sitting position. In portable embodiments of the desktop 10, the cavity 25 may be able to accommodate the lift mechanism 45 with enough room to spare for storage of office supplies or a laptop computer, so the computer can reside within the desktop 10 for safe keeping and easy transport along with the desktop 10.

In some embodiments, one or more computer cooling fans (not shown) can be built into the cover 30 of the desktop 10. The cooling fans are configured to cool the computer or other electronics supported by the work surface 35.

In some portable embodiments, a securing means may be incorporated with the base 15 to help secure the desktop 10 to the surface of the existing table or desk. One possible securing means may be a clamp. Another possible securing means may include the creation of suction. In some embodiments, suction may be created by an integrated, manual or automated vacuum pump with an optional pressure monitoring system.

The desktop 10 of the present disclosure may be provided with a variety of additional features such as wireless charging pads. The desktop 10 may include additional computer peripheral components accessible from the exterior of the desktop 10. For example, one or both of the cover 30 and peripheral wall 20 may house additional power outlets or ports such as: Ethernet, USB, HDMI, Firewire, Thunderbolt, etc. Audio input and output may also be included for connection with optional integrated speakers.

Other possible features incorporated into the desktop 10 may include an integrated electronic calendar and a clock with a timer to indicate the amount of time the user is in the standing or sitting position. This information could then be sent either manually or automatically via an internet connection, to the user's health care provider or employer at specified time intervals and could be used in health related incentive programs. The desktop 10 may also include an integrated, retractable cup holder.

The desktop 10 may be configured for interchangeable bases 15 and work surfaces 35 for a customized external appearance or material. Put another way, the lift mechanism 45 within the desktop 10 may be a module easily separated from the base 15 or the cover 30 for ease of replacement, assembly or maintenance. In these embodiments, a plurality of frame members 49 may be considered part of the lift mechanism 45 and, for example, the connection between the lift arms 50 and the cover 30 would be indirect as the cover 30 provides primarily a shell structure.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A height adjustable desktop, comprising:

a base having a fixed peripheral wall extending upwardly from the base to define a cavity;

a cover defining a horizontal work surface for the desktop; and a lift mechanism supporting the cover relative to the base, wherein the lift mechanism comprises:

a linkage comprising at least one pair of lift arms pivotably connecting each side of the base to a respective side of the cover;

a powered linear actuator attached to the base and operatively connected to the linkage, a connecting rod connected between a lift arm of each pair of lift arms; and a lever directly or indirectly coupling the linear actuator to the connecting rod, wherein motion of the linear actuator causes rotation of the connecting rod, and rotation of the connecting rod directly rotates the lift arms, wherein the actuator is configured to selectively activate the linkage to rotate the lift arms from a relatively horizontal position to at least one substantially fixed upright position, thereby raising the work surface from a sitting height to a standing height, and wherein the cover rests upon the peripheral wall at the sitting height to fully enclose the cavity, and the cover is spaced above and offset forward of the base at the standing height, wherein each pair of lift arms includes a front lift arm and a rear lift arm, wherein the front lift arm and the rear lift arm each rotate in the same direction as the cover is raised and lowered.

2. The desktop according to claim 1, wherein the front lift arm has a lower arm portion and an upper arm portion, wherein the upper arm portion of the front lift arm is angled rearward relative to the lower arm portion thereof; and wherein the rear lift arm has a lower arm portion and an upper arm portion, wherein the upper arm portion of the rear lift arm is angled forward relative to the lower arm portion thereof, such that each pair of lift arms is capable of a compact nested position when the cover is at the sitting height.

3. The desktop according to claim 1, wherein the lift mechanism is triggered by a switch mounted to the fixed peripheral wall.

4. The desktop according to claim 1, wherein the lift mechanism is triggered by a remote control.

5. The desktop according to claim 1, wherein the lift mechanism is configured such that the cover may selectively stop and remain steady at various heights between the sitting height and the standing height.

6. The desktop according to claim 1, wherein the lift mechanism further comprises at least one support rod extending between at least one of the lift arms and the cover to provide support for a front portion of the cover when in the standing height.

7. The desktop according to claim 6, wherein the support rod is pivotably attached to the respective lift arm and slidably attached to the cover.

8. A support, comprising:

a base for placement upon an existing desk or table;

a cover defining a horizontal work surface; and a lift mechanism supporting the cover relative to the base, wherein the lift mechanism comprises:

a linkage comprising at least one pair of lift arms pivotably connecting each side of the base to a corresponding side of the cover;

a powered linear actuator attached to the base and operatively connected to the linkage;

a connecting rod capable of rotation along with at least one of the lift arms; and a lever directly or indirectly converting linear motion of the linear actuator to a torque rotating the connecting rod, and rotation of the connecting rod directly rotates the lift arms, wherein the linear actuator is configured to selectively activate the linkage to rotate the lift arms from a relatively horizontal position to at least one substantially fixed upright position, thereby raising the work surface from a sitting height to a standing height, and wherein the cover is spaced above and offset forward of the base at the standing height.

9. The support according to claim 8, wherein the base further comprises a fixed peripheral wall extending upwardly therefrom to define a cavity, and wherein the cover rests upon the peripheral wall at the sitting height to fully enclose the cavity.

10. The support according to claim 9, wherein the lift mechanism is triggered by a switch mounted to the fixed peripheral wall.

11. The support according to claim 8, wherein the lift mechanism is configured such that the cover may selectively stop and remain steady at various heights between the sitting height and the standing height.

12. The support according to claim 8, wherein the lift mechanism further comprises at least one support rod rotatably coupled to at least one of the lift arms and slidably coupled to the cover, wherein the support rod is biased toward the cover.

13. The support according to claim 8, wherein each pair of lift arms includes a front lift arm and a rear lift arm, wherein the front lift arm has a lower arm portion and an upper arm portion, wherein the upper arm portion of the front lift arm is angled rearward relative to the lower arm portion thereof; and wherein the rear lift arm has a lower arm portion and an upper arm portion, wherein the upper arm portion of the rear lift arm is angled forward relative to the lower arm portion thereof, such that each pair of lift arms is capable of a compact nested position when the cover is at the sitting height.

14. A device, comprising:

a cover defining a horizontal work surface; and a lift mechanism supporting the cover, wherein the lift mechanism comprises:

a linkage comprising at least one pair of lift arms pivotably connected to each side of the cover;

a powered linear actuator operatively connected to the linkage;

a connecting rod connected between a lift arm of each pair of lift arms; and a lever directly or indirectly coupling the linear actuator to the connecting rod, wherein motion of the linear actuator causes rotation of the connecting rod, and rotation of the connecting rod directly rotates the lift arms, thereby raising the cover from the sitting height to the standing height.

15. The device of claim 14, wherein the cover is a desktop, and the lift mechanism is integrated into a desk.

* * * * *